US006959748B2

(12) United States Patent
Hudoba

(10) Patent No.: US 6,959,748 B2
(45) Date of Patent: Nov. 1, 2005

(54) APPARATUS FOR COVERING AN OPENING IN A BUILDING

(75) Inventor: Mark Hudoba, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/313,057

(22) Filed: Dec. 6, 2002

(65) Prior Publication Data

US 2004/0107655 A1 Jun. 10, 2004

(51) Int. Cl.[7] ..... A47H 1/00
(52) U.S. Cl. ..... 160/31; 160/121.1; 160/305
(58) Field of Search ..... 160/31, 121.1, 160/265, 266, 267.1, 268.1, 269, 300, 305; 52/202, 203, 222

(56) References Cited

U.S. PATENT DOCUMENTS

| | | | | | |
|---|---|---|---|---|---|
| 2,094,444 | A | * | 9/1937 | Bozin | 160/315 |
| 2,131,521 | A | * | 9/1938 | Nye | 160/278 |
| 3,661,195 | A | * | 5/1972 | Fischer | 160/373 |
| 3,752,208 | A | * | 8/1973 | Roberts | 160/1 |
| 3,978,629 | A | * | 9/1976 | Echols, Sr. | 52/235 |
| 4,102,385 | A | | 7/1978 | Miller | 160/263 |
| 4,112,996 | A | * | 9/1978 | Fohl | 160/296 |
| 4,275,645 | A | * | 6/1981 | Ruff | 454/188 |
| 4,357,978 | A | * | 11/1982 | Keller et al. | 160/41 |
| 4,458,739 | A | | 7/1984 | Murray | |
| 4,781,235 | A | * | 11/1988 | Hedstrom et al. | 160/269 |
| 4,826,236 | A | * | 5/1989 | Bennett | 296/186.2 |
| 4,991,638 | A | * | 2/1991 | Magee et al. | 160/31 |
| 4,993,468 | A | * | 2/1991 | Hackman et al. | 160/27 |
| 5,080,298 | A | * | 1/1992 | Sasaki et al. | 242/372 |
| 5,457,921 | A | | 10/1995 | Kostrzecha | 52/202 |
| 5,579,794 | A | | 12/1996 | Sporta | 135/88.01 |
| 5,632,317 | A | | 5/1997 | Krupke et al. | 160/265 |
| 5,671,790 | A | * | 9/1997 | Andersen et al. | 160/24 |
| 5,794,678 | A | * | 8/1998 | Beringer et al. | 160/41 |
| 5,868,191 | A | * | 2/1999 | Blackmon, Jr. | 160/31 |
| 5,918,430 | A | | 7/1999 | Rowland | 52/202 |

(Continued)

FOREIGN PATENT DOCUMENTS

| | | | | |
|---|---|---|---|---|
| AT | 399 200 B | | 3/1995 | E06B/9/42 |
| EP | 0 3 97 619 A | | 11/1990 | E06B/9/80 |
| EP | 0753422 | * | 1/1997 | 160/31 X |
| EP | 0 775 797 A | | 5/1997 | E06B/9/58 |
| EP | 0 816 624 A | | 1/1998 | E06B/9/13 |
| FR | 2 771 132 A | | 5/1999 | E06B/9/42 |
| JP | 3733 | * | 1/2003 | 160/31 X |
| JP | 39633 | * | 2/2003 | 160/305 X |

*Primary Examiner*—Bruce A. Lev
(74) *Attorney, Agent, or Firm*—Renner, Kenner, Greive, Bobak, Taylor & Weber

(57) ABSTRACT

A storm protector (20) to be attachable over a window (21) or other opening of a building (22) includes a header (26), a bottom sill (25) and side frames (23, 24) extending between the ends of the header (26) and the sill (25). The header (26) carries a tube (53) which has one end of a curtain assembly (27) attached thereto. The curtain assembly (27)is biased by a spring (54) to be normally coiled on the tube (53), but the curtain assembly (27) may be manually moved along the frames (23, 24) to the sill (25) to cover the window opening (21). A bar (31) is formed at the other end of the curtain assembly (27), and the bar (31) carries a guide and lock assembly (110) which rides in and can engage at least one of the side frames (23, 24) to guide and selectively hold the curtain assembly (27) at any selected position along the side frames (23, 24). A tensioning assembly (32) is positioned in the header (26) and, without disassembling the protector (20), it may be accessed to adjust the tension of the spring (54). The header (26) includes a sealing surface (50), the sill (25) includes a sealing surface (105) and each side frame (23, 24) includes a sealing surface (89). A force upon the curtain assembly (27) causes it to engage the sealing surfaces (50, 89, 105) to provide a full perimeter seal around the window opening (21).

30 Claims, 8 Drawing Sheets

U.S. PATENT DOCUMENTS 6,095,224 A 8/2000 Miller ..... 160/133
6,100,659 A 8/2000 Will et al. ..... 318/466
6,257,305 B1 7/2001 Mullet et al. ..... 160/310
6,296,039 B1 10/2001 Mullet et al. ..... 160/267.1
6,405,781 B2 * 6/2002 Davies et al. ..... 160/23.1
6,408,922 B2 * 6/2002 Desrochers ..... 160/24
6,618,998 B1 * 9/2003 Thomas et al. ..... 52/63
6,666,251 B2 * 12/2003 Ikle ..... 160/120
2003/0075281 A1 * 4/2003 Goldenberg et al. ..... 160/23.1
2003/0079844 A1 * 5/2003 DeBlock et al. ..... 160/31
2003/0230389 A1 * 12/2003 Savard et al. ..... 160/133

* cited by examiner

APPARATUS FOR COVERING AN OPENING IN A BUILDING

TECHNICAL FIELD

This invention relates to a device for covering an opening in a structure, such as a window or the like, to protect the structure's envelope from being breached by impact from debris or high velocity wind loads. More particularly, this invention relates to such a device which can seal and protect the opening against the pressure of the wind.

BACKGROUND ART

Extreme weather-created phenomenon, such as hurricanes, typhoons, tornadoes, or the like can often cause damage to building structures. Such storm-related damage frequently occurs when high winds and/or debris carried thereby invades the structure through its weakest points, its openings, such as windows or doors. Once invaded, the structure is vulnerable to further damage to the interior thereof, and thus, particularly in geographic areas susceptible to frequent violent weather conditions, it is important to protect the weakest portions of a structure, at least the windows and the doors, with some type of covering.

Most traditionally, home or building owners, if alerted to an oncoming storm, cover these portions of their structures by nailing boards over them. However, this "boarding up" procedure is not only time consuming, when time is usually of the essence, but such can also disfigure the exterior of the structure upon the frequent installation and removal of the boards. Moreover, storing or maintaining an inventory of the boards can take up a great deal of space which would otherwise be usable for other purposes.

As a result, a number of temporarily installable or permanently installed devices have been developed in an attempt to protect these portions of a structure. Some of these devices are in the form of a shutter consisting of a plurality of hinge-connected slats. These shutters can be rolled up and away from the portion of the building being protected by a hand crank or motor. However, these types of devices are not only costly, but also they do not provide for an adequate seal irrespective of whether they are mounted on the windward or leeward side of the structure.

Other alternatives to these shutter-like devices are fabric-based systems. These systems, while less expensive than their counterparts, are often quite large, cumbersome, and difficult to install. Usually, they are attached to an overhang or an eave and must be positioned at a distance in excess of two feet, from the window or door to be protected. They must be specially designed for each such item to be covered, dependent on the nature of the item and its location relative to an overhang or an eave, and they are usually quite large, presenting installation and storage issues.

The need exists, therefore, for a system which will not be plagued by these problems of the prior art.

DISCLOSURE OF THE INVENTION

It is thus an object of the present invention to provide a device for covering an opening, such as a window or a door, of a building structure.

It is another object of the present invention to provide a device, as above, which is in the form of a curtain of a flexible material which may be manually operated to be positioned over the opening.

It is a further object of the present invention to provide a device, as above, in which the curtain may be wound up by a spring and stored at a position adjacent to the opening.

It is yet another object of the present invention to provide a device, as above, in which the tension on the spring may be adjusted without disassembling the device.

It is still a further object of the present invention to provide a device, as above, wherein the curtain may be held open at a plurality of positions.

It is an additional object of the present invention to provide a device, as above, which can protect and provide a full perimeter seal for the opening against the pressure of the wind.

These and other objects of the present invention, as well as the advantages thereof over existing prior art forms, which will become apparent from the description to follow, are accomplished by the improvements hereinafter described and claimed.

In general, a device for covering an opening in a building made in accordance with one aspect of the present invention includes opposed frames with a curtain assembly being manually movable along the frames. A device is carried by the curtain assembly to selectively be received by at least one of the frames to guide the curtain assembly along the frames.

In accordance with another aspect of the present invention, a device for covering an opening in a building includes a tube having one end of a curtain assembly attached thereto. The curtain assembly is adapted to be coiled on the tube when it is not covering the opening and to be uncoiled from the tube to cover the opening. A spring is provided to bias the curtain assembly toward the coiled position, and a tension adjusting system is provided which adjusts the tension of the spring without having to disassemble the apparatus.

In accordance with yet another aspect of the present invention, a device for covering an opening in a building includes an upper member, a lower member, and opposed side members which extend between the edges of the upper and lower members. Together, the upper, lower and side members form the periphery of the device. A curtain assembly is adapted to extend between the upper and lower members and between the side members to cover the space therebetween. The upper, lower and side members each have a sealing surface so that when the curtain assembly is exposed to a force, the periphery of the curtain assembly can engage each sealing surface.

A preferred exemplary device for covering an opening in a building incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
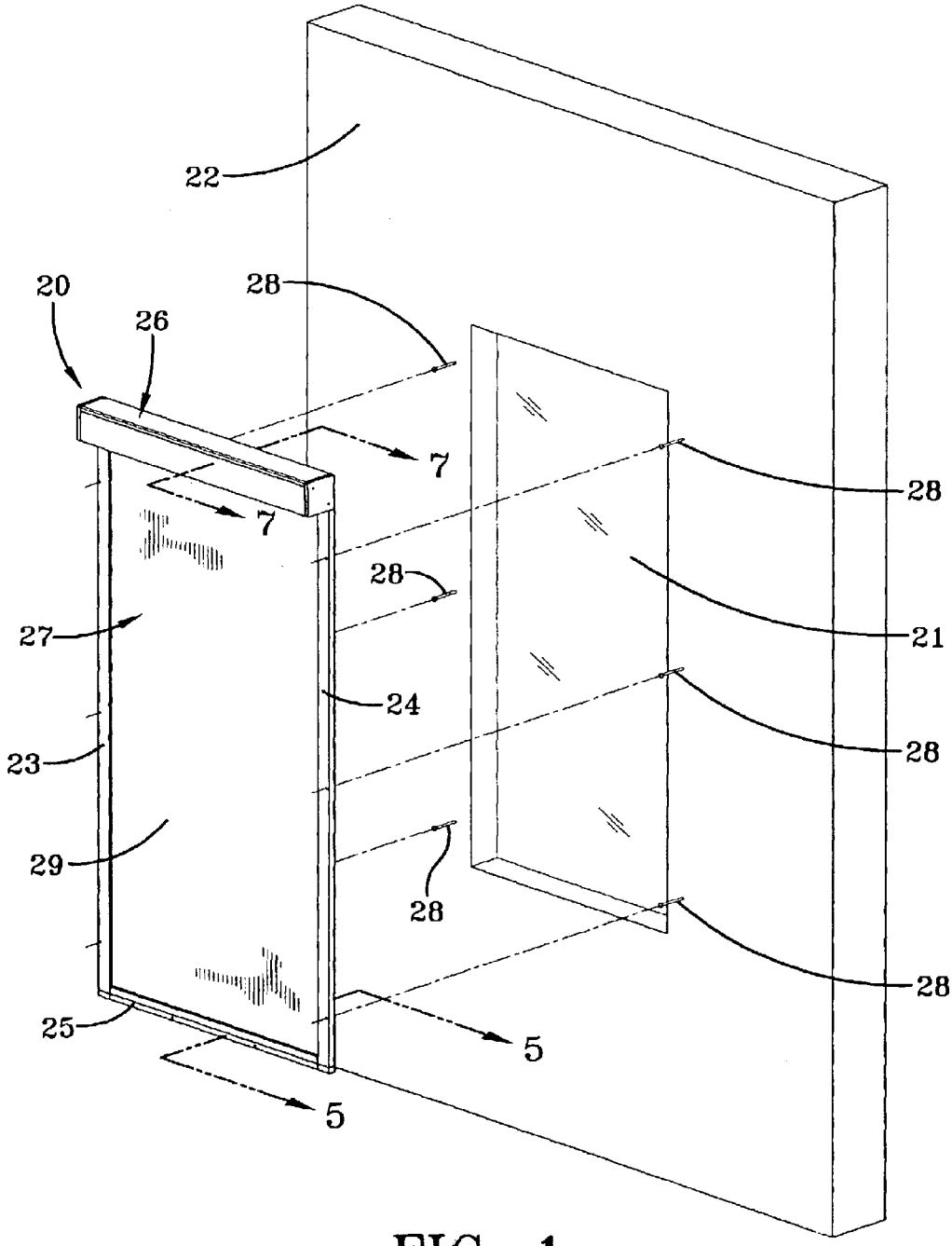
FIG. 1 is a perspective view of a device made in accordance with the concept of the present invention and showing the manner in which it may be received over a window of a structure.

A storm protection device made in accordance with the present invention is indicated generally by the numeral 20 and is shown in FIG. 1 as being attachable over a window 21 or other opening of a structure 22. Storm protection device 20 includes opposed side frames 23, 24, a bottom sill 25 extending between the lower end of frames 23 and 24, a header or curtain storage area 26 extending between the upper end of frames 23 and 24, and a curtain assembly generally indicated by the numeral 27. Device 20 can be attached to structure 22 by means of conventional fasteners 28 received through frames 23, 24.

Curtain assembly 27 includes a sheet of fabric 29 having a strip of material 30 attached to each vertical edge thereof. Strips 30 can be separate pieces of material attached to fabric sheet 29 such as by sewing, gluing, or welding, or alternatively, the edges of sheet 29 could be folded over and sewn to form the thickened edges otherwise created by strips 30 on sheet 29. The fabric of sheet 29 can be of any sturdy, preferably lightweight, material which is weather resistant and which can withstand the forces generated by high winds or flying debris. For example, a vinyl- or urethane-coated nylon or polyester fabric would be suitable for sheet 29.

Figure 7:
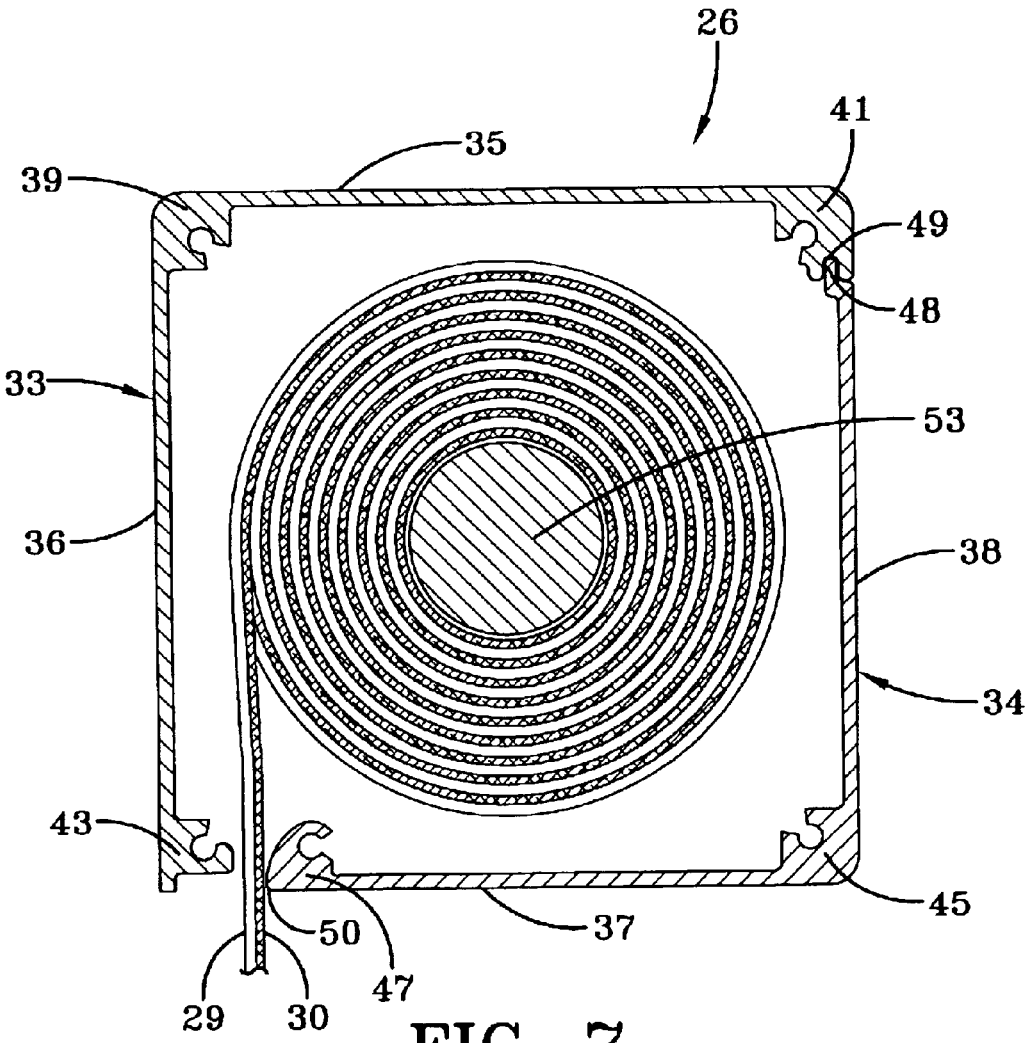
FIG. 7 is a sectional view taken substantially along line 7—7 of FIG. 1 showing the flexible material in a retracted condition.

Curtain assembly 27 also includes a bar 31 attached to one end of fabric sheet 29. The other end of fabric sheet 29 is carried by a tensioning assembly, best shown in FIG. 9 and generally indicated by the numeral 32. Tension assembly 32 is part of header 26, and, as will hereinafter be described in detail, when not in use, fabric sheet 29 is coiled within header 26, as shown in FIG. 7. Although header 26 is shown at the top of storm protection device 20 with curtain assembly 27 being movable vertically therefrom, it will become evident that header 26 could be formed at the side of device 20 and with the curtain assembly then being movable horizontally across device 20 without departing from the spirit of this invention.

Header 26 includes a housing to store curtain assembly 27 which can be conveniently formed from two housing portions generally indicated by the numerals 33 and 34. As shown in FIG. 7, when assembled in a manner to be hereinafter described, housing portion 33 forms the top surface 35 and one side surface 36 of the header 26, and housing portion 34 forms the bottom surface 37 and an opposed side surface 38 of header 26.

Figure 9:
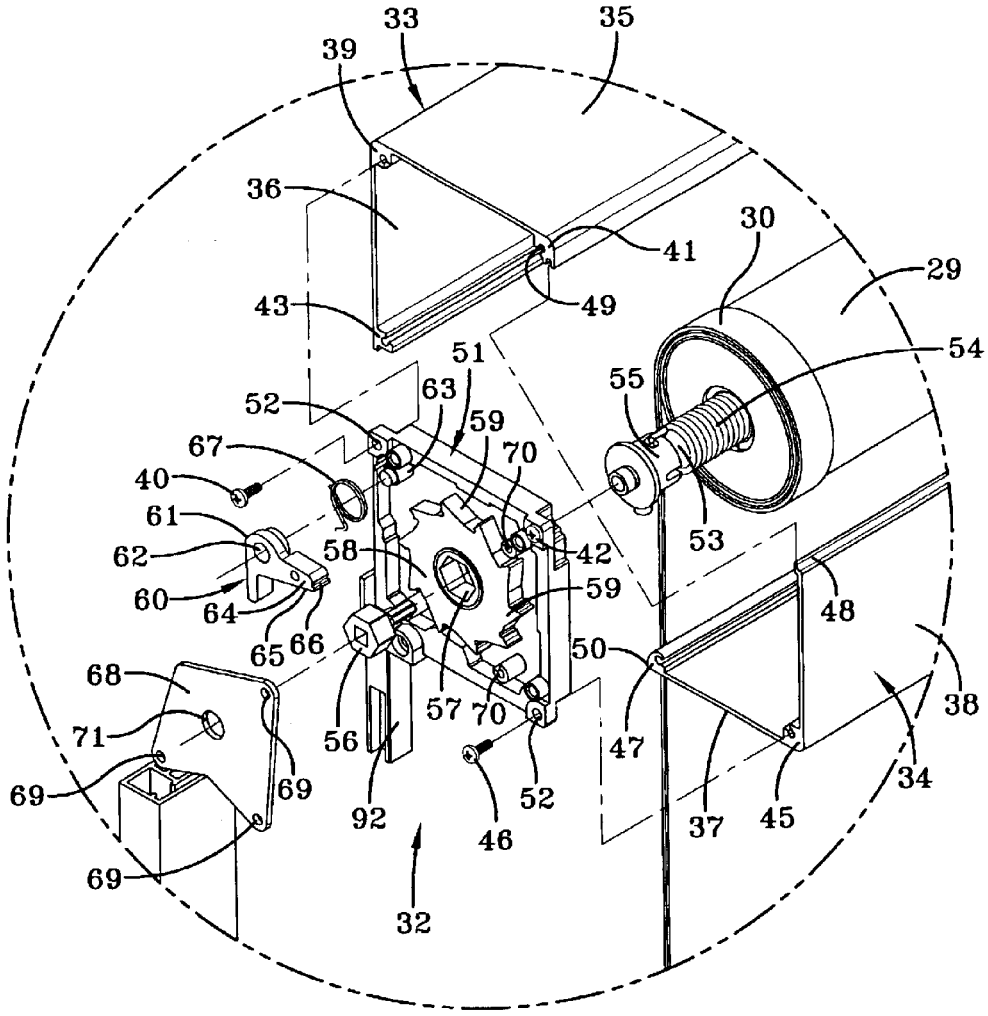
FIG. 9 is an enlarged exploded perspective view of the portion of the device circled in FIG. 2 and labeled 9.
Figure 10:
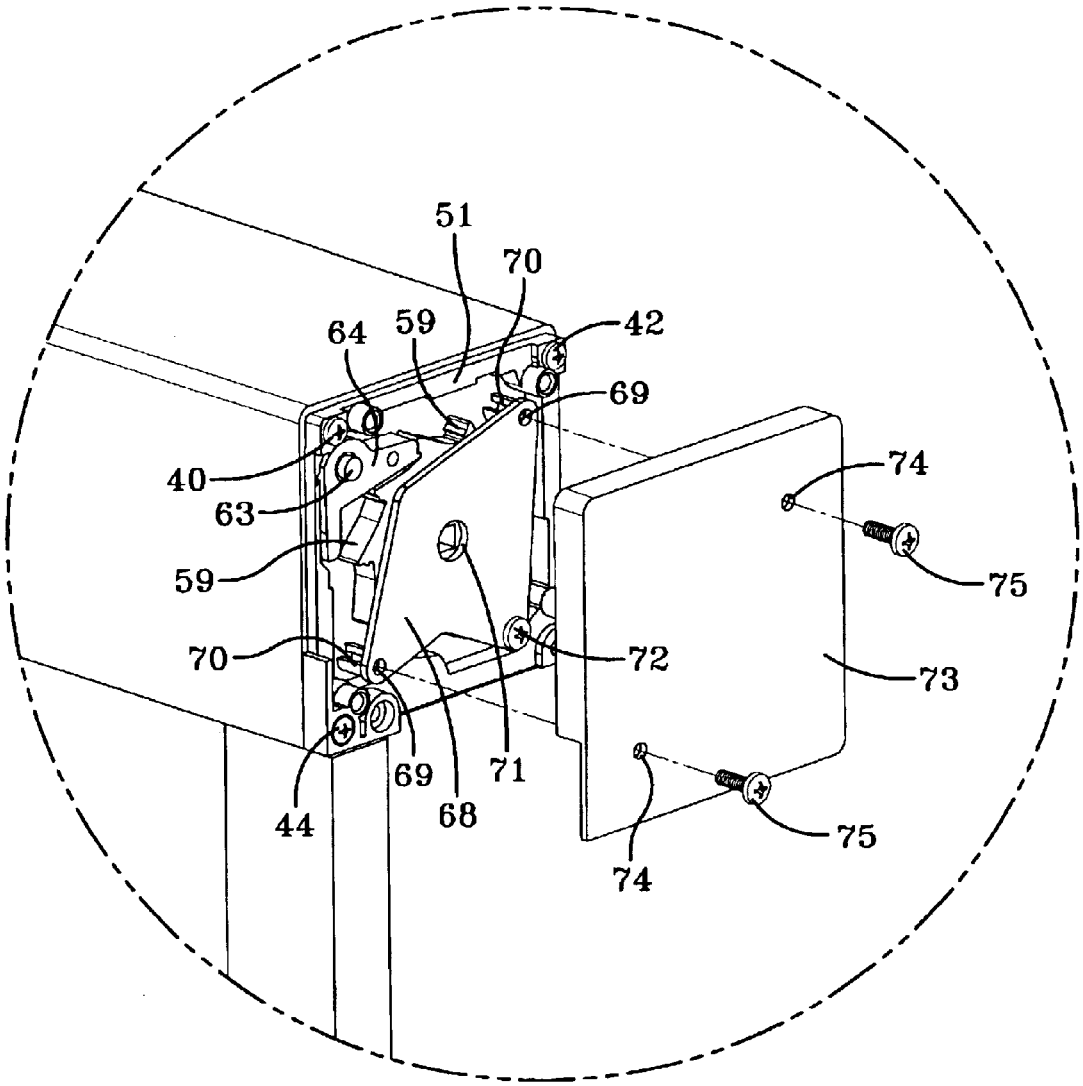
FIG. 10 is a partially exploded perspective view showing the majority of the components of FIG. 9 assembled.

The junction of top surface 35 and side surface 36 of housing portion 33 is formed with a lug 39 to receive a fastener 40 (FIG. 9). The opposite end of top surface 35 is formed with a lug 41 to receive a fastener 42 (FIG. 9), and, similarly, the opposite end of side surface 36 is formed with a lug 43 to receive a fastener 44 (FIG. 10).

The junction of bottom surface 37 and side surface 38 of housing portion 34 is likewise formed with a lug 45 to receive a fastener 46 (FIG. 9), the opposite end of bottom surface 37 being formed with a lug 47 to receive a fastener (not shown). The opposite end of side surface 38 is formed with a tongue 48 which fits within a groove 49 formed in lug 41.

When header 26 is assembled, lug 43 of side surface 36 is spaced from lug 47 of bottom surface 37 to provide a space or opening for the fabric sheet 29 to pass therebetween. Also, as will hereinafter be described in more detail, a sealing surface 50 is formed on lug 47 SO that when fabric sheet 29 is receiving wind pressure, as coming from the left in FIG. 7, sheet 29 will deflect and engage surface 50 to seal the top periphery of curtain assembly 27.

As shown in FIG. 9, housing portions 33 and 34 are maintained assembled to form header 26 by means of end caps 51 which can be slid into each end of housing portions 33 and 34 and attached thereto by virtue of apertures 52 near the four corners thereof which are aligned with aperture lugs 39, 41, 43 and 45 to receive fasteners 40, 42, 44 and 46 therethrough, respectively.

As shown in FIGS. 7 and 9, a supply of the fabric sheet 29 is maintained within header 26 and is coiled on a counterbalance tube 53 which is part of tensioning assembly 32 and which, as was previously described, is attached to one end of sheet 29. As will now become evident, tube 53 and the tensioning assembly 32 allow the fabric sheet 29 to be coiled thereon or uncoiled therefrom. To that end, a counterbalance spring 54 has one end attached to turn with tube 53, and its other end is attached to a driver 55. The outer end of driver 55 extends through an opening (not shown) in end cap 51 and receives a splined extension of a nut 56 which is engaged by the inner configuration of an aperture 57 formed in a gear plate 58. The periphery of plate 58 is provided with a plurality of radially projecting teeth 59.

Teeth 59 interrelate with a pawl assembly, generally indicated by the numeral 60, to incrementally maintain the position of the end of spring 54 by way of driver 55. While gear plate 58 is shown as having ten teeth 59, the number thereof may be increased or decreased depending on the amount of the desired tensioning increment. That increment, in terms of one revolution of gear plate 58, is basically inversely proportioned to the number of teeth 59. Thus, in the embodiment shown with ten teeth, there is a tensioning increment of 1/10 of a revolution.

As shown in FIGS. 9 and 10, pawl assembly 60 interacts with teeth 59 to hold plate 58 against the force of spring 54. Pawl assembly 60 includes a pivot portion 61 having an aperture 62 therethrough which is received on a hub 63 formed on end cap 51. A tooth engaging arm 64 extends outwardly from pivot portion 61 toward gear plate 58. Arm 64 is a wedge-like member having a first flat surface 65 that is engaged by the leading surface of a tooth 59 and a second surface 66 that engages the trailing side of a tooth 59 to hold gear plate 58 against rotation. Pawl assembly 60 also preferably includes a spring 67 which is received around hub 63 and, as would be evident to one skilled in the art, is positioned so as to exert a force to urge arm 64 toward engagement with gear plate 58.

The components of the tensioning assembly 32 are maintained housed within one end cap 51 by an end plate 68. Plate 68 is provided with three peripheral apertures 69 which are alignable with fastener receiving lugs 70 formed on frame 51. A generally central aperture 71 in plate 68 is positioned so as to expose nut 56. As shown in FIG. 10, at least one fastener 72 may be employed to extend through one of the apertures 69 and into one of the lugs 70 to hold plate 68 onto frame 51. A cover plate 73 is provided to completely close off each end of header 26, and it is preferably provided with two apertures 74 which, on the end of header 26 having tensioning assembly 32, which can be aligned with two of the apertures 69 of plate 68 so that fasteners 75 may be received through apertures 69 and 68 and into lugs 70.

The tension on spring 54 may thus be readily and easily adjusted by the structure just described. To that end, all that one need do is remove cover plate 73 so that adjusting nut 56 is exposed through aperture 71 of plate 68. Then nut 56 can be turned clockwise to overcome the force of pawl 60 and incrementally add tension to spring 54. If it is desired to remove tension from spring 54, nut 56 can be rotated slightly in the tensioning direction until pawl 60 can be freed from engagement of gear plate 58 which is accomplished by manually rotating pawl 60 to overcome the bias of spring 67. With arm 64 thus out of engagement with teeth 59, rotation of nut 56 in the non-tensioning direction (counterclockwise) will remove tension from spring 54. Thus, the tensioning of spring 54 is readily adjustable by removing only cover plate 73 and not otherwise having to disassemble the device.

The identical cross-sectional configuration of side frames 23 and 24 can be best described with reference to side frame 24 shown in FIG. 6A. Side frame 24 includes a front or outer surface 80 spaced from a rear or inner surface 81 by an outer end wall 82. When device 20 is installed, inner surface 81 is positioned against structure 22. An inner end wall 83 is formed at the inner end of surface 81 but does not extend all the way to front surface 80. Rather, it terminates short of an intermediate wall 84 thereby creating a space to receive the edge of curtain assembly 27. Intermediate wall 84 is formed generally parallel to front and rear surfaces 80, 81 and is supported by a stub wall 85 extending between front surface 80 and wall 84, and by a support wall 86 extending between rear surface 81 and wall 84. A reinforcing wall 87 is positioned parallel to wall 84, and surface 80 and surface 81, and extends between inner end wall 83 and support wall 86.

The thickened edge of the fabric sheet 29 having strip 30 is thus received in a compartment 88 formed between wall 86, the end of wall 83, and walls 84 and 87. Sheet 29 is inserted into compartment 88, and once there, sheet 29 cannot be readily pulled out because strip 30 or the thickened area is engaged by the end of wall 83.

It should be noted that a sealing surface 89 is formed on the end of wall 83. As such, when the wind is blowing against the fabric sheet 29 (in the up direction of FIGS. 6A and 6B), the sheet 29 is forced against surface 89, thereby effecting a seal along each side of fabric sheet 29, in the same manner that surface 50 effects a top seal. Moreover, if the device 20 is protecting a window 21 on the leeward side of structure 22, the vacuum condition shown in FIG. 6C may occur with the thickened area 30 of sheet 29 engaging wall 87, as the wind passes over the top of structure 22.

Figure 2:
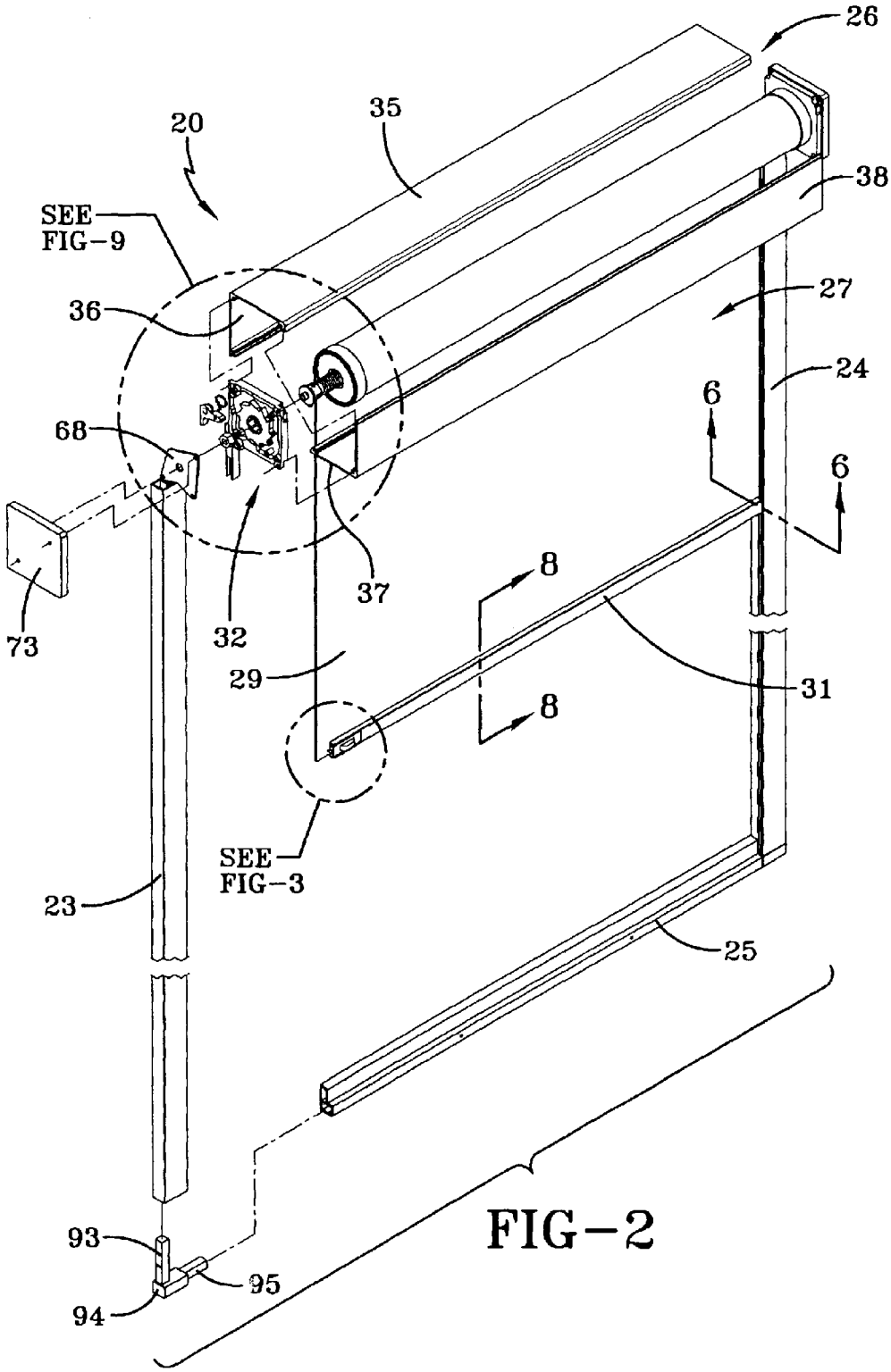
FIG. 2 is an exploded perspective view of the device of FIG. 1.
Figure 5A:
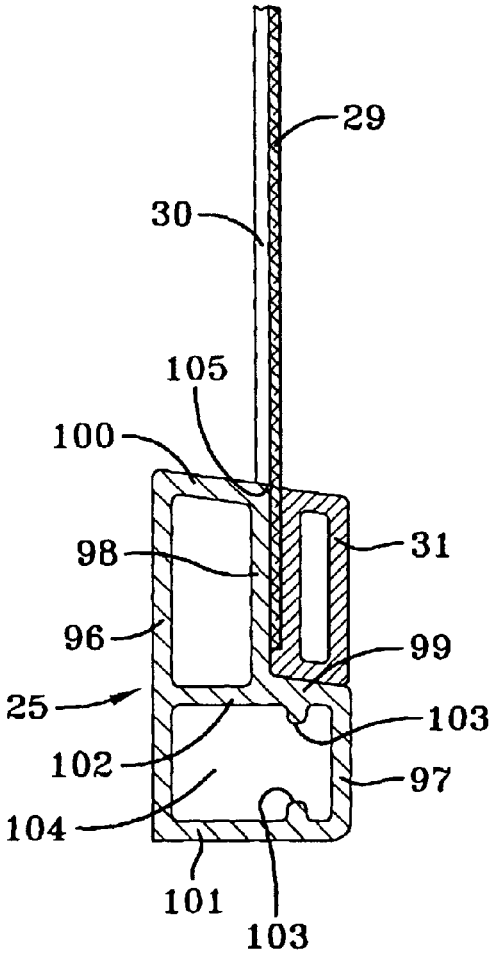
FIG. 5A is a sectional view taken substantially along line 5—5 of FIG. 1 showing the flexible material of the device under pressure from wind directed there against.

Side frames 23 and 24 also include opposed nubs 90 extending from walls 82 and 86 toward each other to form, with walls 81, 82 and 86, a socket 91. Socket 91 is configured to enable side frames 23 and 24 to be attached to sill 25 and header 26. That is, a post 92 formed on end cap 51 of header 26 is snugly received in the upper end of socket 91, and it can be held in place, if necessary, by fasteners (not shown). The lower end of socket 91 is adapted to snugly receive one post 93 of a corner key 94 (FIG. 2). Like post 92, if necessary, post 93 can be more permanently held in place in frames 23, 24 by fasteners (not shown). Corner key 94 also includes a second post 95 positioned normal to post 93. Posts 95 of each corner key 94 are adapted to be received in sill 25, as now to be described with reference to FIGS. 5A and 5B.

Sill 25 is formed with an inner surface 96, which will be positioned adjacent to the structure 22 when device 20 is installed, and a stepped outer surface consisting of a lower portion 97 and an upper portion 98. A step 99 is formed between portions 97 and 98 which serves as a ledge for bar 31 which, as previously described, is attached to the bottom of fabric sheet 29. A top wall 100 extends between upper portion 98 of the outer surface and inner surface 96, and a bottom wall 101 extends between lower portion 97 of the outer surface 80 and inner surface 96. A reinforcing wall 102 extends between the bottom of wall portion 98 and inner surface 96. Opposed nubs 103 extend toward each other from step 99 and lower wall 101 to form with inner surface 96, wall portion 97 and lower wall 101, a socket 104. Socket 104 is configured to snugly receive, at each end, posts 95 of corner keys 94 to attach sill 25 between frames 23 and 24. If necessary, fasteners (not shown) may be utilized to make the connection more permanent.

Figure 5B:
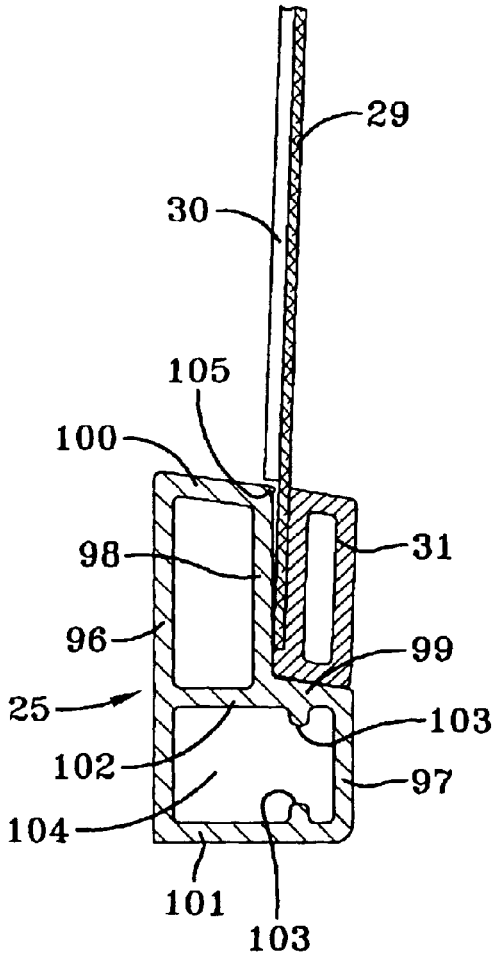
FIG. 5B is a sectional view like FIG. 5A but showing the flexible material in a vacuum condition.

A sealing surface 105 is formed at the junction of top wall 100 and portion 98 of the stepped outer surface. As such, when the wind is blowing against the fabric sheet 29 (right to left in FIG. 5A), the sheet 29 is forced against surface 105 thereby effecting a seal along the bottom of fabric sheet 29 in the same manner that surface 50 effects a top seal, and surfaces 89 effect side seals. As a result, device 20 is provided with full perimeter sealing established by the force of the wind itself. FIG. 5B shows the lower portion of the fabric sheet 29 in the condition that it might be in when device 20 is protecting a window on the leeward side of structure 22.

Figure 8:
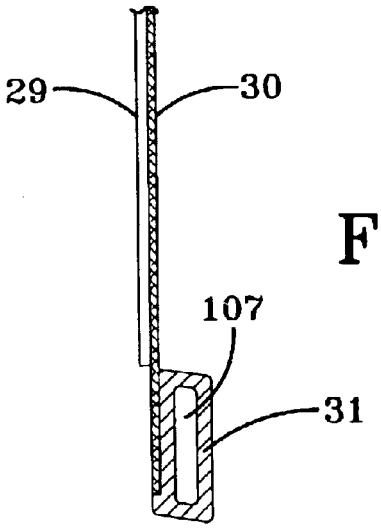
FIG. 8 is a sectional view taken substantially along line 8—8 of FIG. 2.

As curtain assembly 27 is being manually moved up and down, it is desirable that the edges thereof be guided in a track-like fashion by side frames 23 and 24. For that purpose, a slot 106 is formed in side frames 23 and 24 located between the inner end of intermediate wall 84 and the inner end of front surface 80. In its most simple form, the device which guides the fabric sheet could be a member (not shown) which is inserted into the hollow portion 107 of bar 31 (FIG. 8), that member having an outwardly extending flange capable of riding in slots 106 of side frames 23 and 24. However, in accordance with one aspect of the present invention, the guiding device could also serve a locking function to hold curtain assembly 27 in the fully closed position, as shown in FIG. 1, or in any intermediate position, as shown in FIG. 2, should that be desired, in instances, for example, when the owner of the structure 22 is using curtain assembly 27 as a partial shade for window 21.

Figure 3:
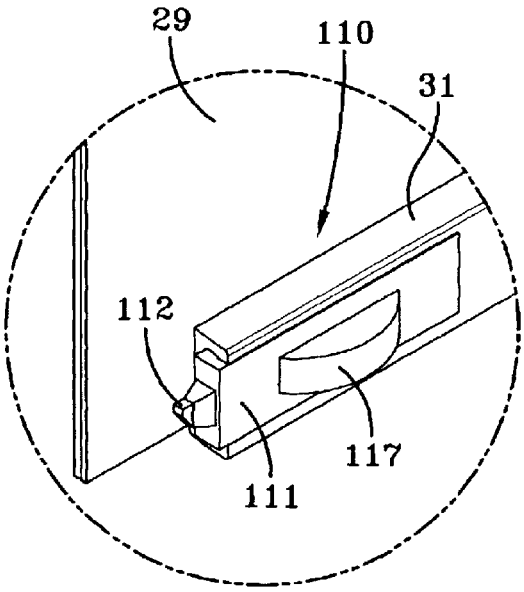
FIG. 3 is an enlarged view of a locking mechanism of the device circled in FIG. 2 and labeled 3, showing the mechanism in the locked position.
Figure 4:
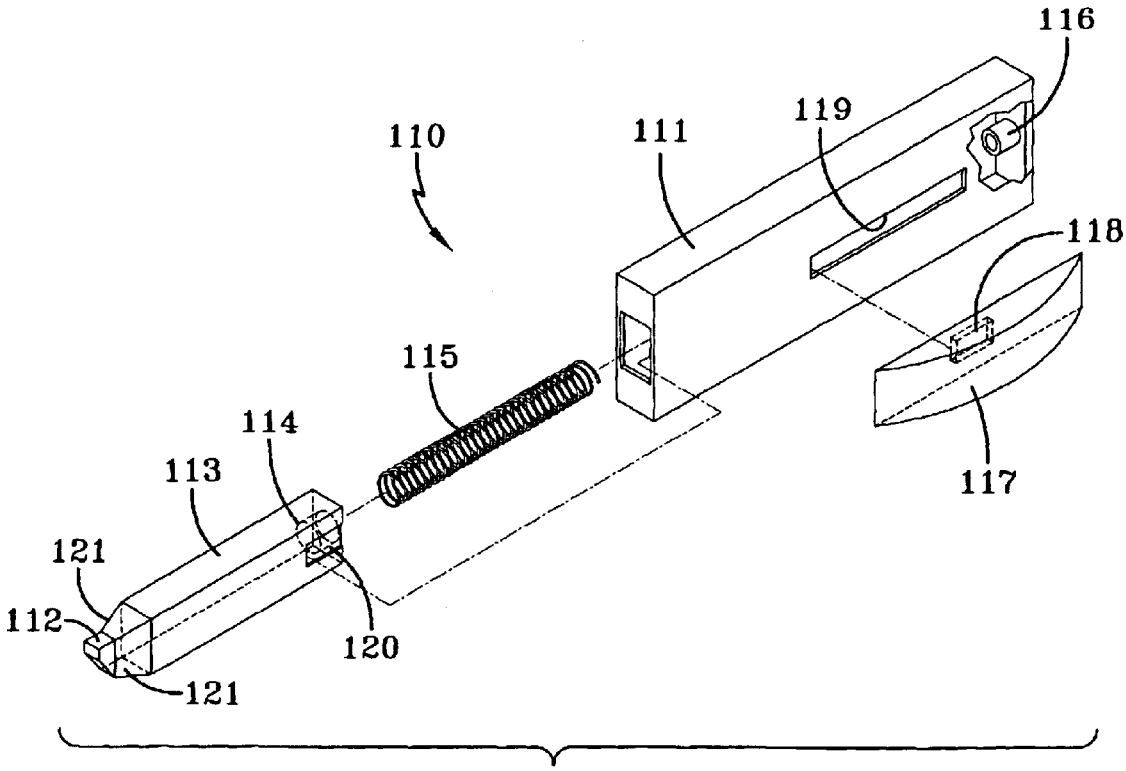
FIG. 4 is an exploded view of the locking mechanism shown in FIG. 3.

To that end, bar 31 is provided with a guiding and locking assembly generally indicated by the numeral 110 and shown in FIGS. 3, 4 and 6. Assembly 110 includes a housing 111 which is carried by bar 31 near at least one end thereof, but preferably at both ends thereof so as to be interrelated to both frames 23 and 24. Each housing 111 has an opening therein through which a flange 112 of a plunger 113 extends.

Plunger 113 has a socket 114 formed at its other end to receive one end of coil spring 115. The other end of spring 115 is piloted over a lug 116 formed in housing 111. A button 117 has a tab 118 which is received through a slot 119 in housing 111 to engage a recess 120 formed in plunger 113.

Figure 6A:
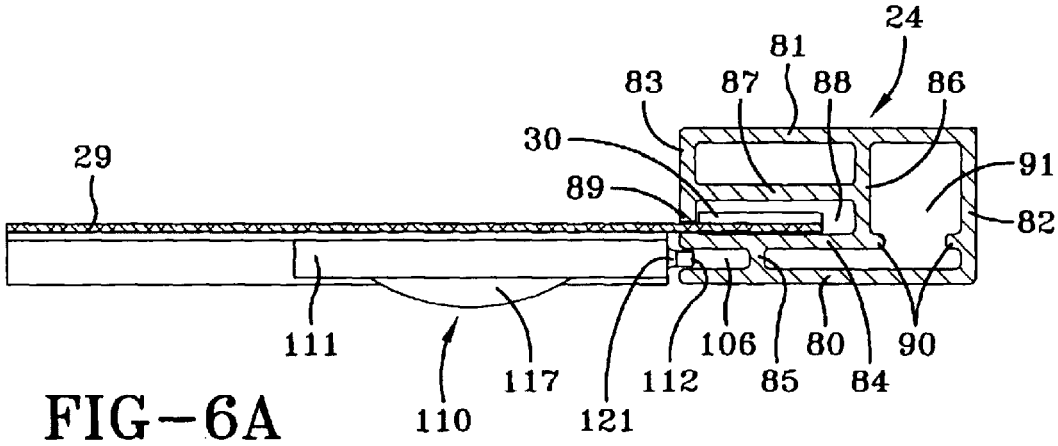
FIG. 6A is a sectional view taken substantially along line 6—6 of FIG. 2 showing the mechanism of FIG. 3 in an unlocked condition and showing flexible material of the device under pressure from wind directed there against.
Figure 6B:
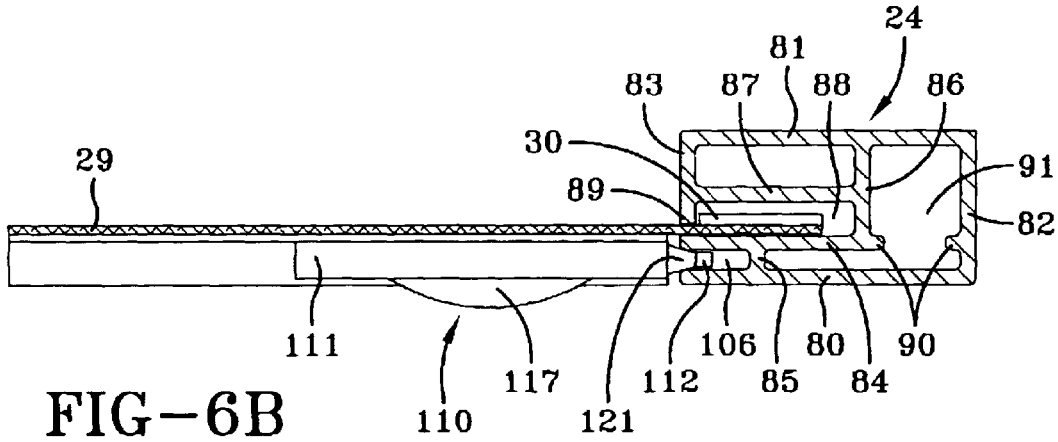
FIG. 6B is a sectional view like FIG. 6A showing the mechanism of FIG. 3 in a locked condition.
Figure 6C:
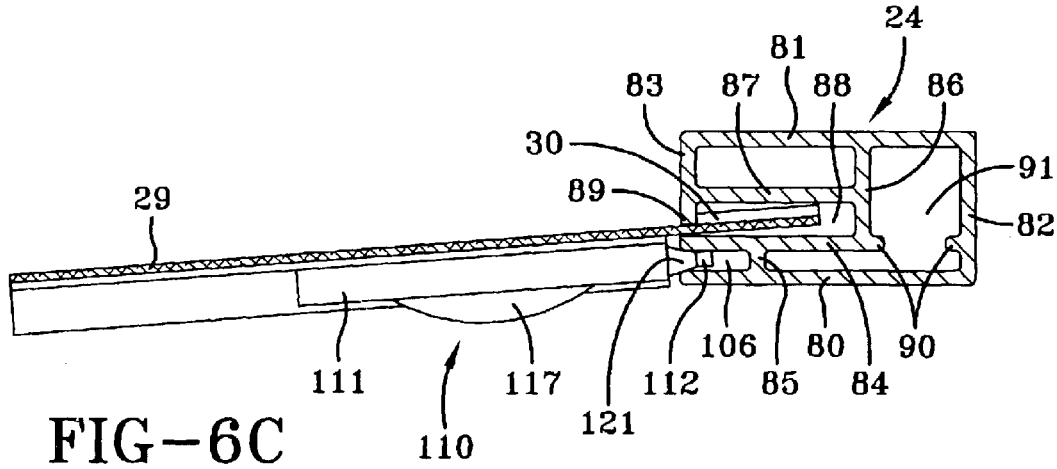
FIG. 6C is a sectional view like FIG. 6B but showing the flexible material in a vacuum condition.

As shown in FIGS. 3, 6B and 6C, spring 115 normally acts on plunger 113 so that flange 112 is in slot 106 of the side frame 23 and/or 24 adjacent to assembly 110. Flange 112 is tapered on both sides thereof, as at 121, so as to be generally wedged in slot 106 as shown in FIG. 6B. In this position, curtain assembly 27 is held in place relative to frames 23 and 24 at a height selected by the user. The taper 121 also permits the pivoting of flange 112 in slot 106 under certain wind conditions as shown in FIG. 6C.

Figure 3A:
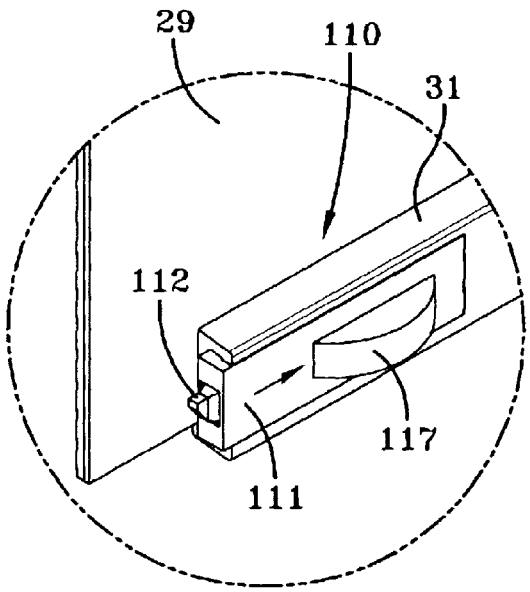
FIG. 3A is a view similar to FIG. 3 but showing the locking mechanism in an unlocked condition.

When it is desired to unlock curtain assembly 27 and move it to a new position, the user merely slides button 117 as shown in FIG. 3A to overcome the bias of spring 115 to retract the tapered portion of flange 112 from slot 106 so that, as shown in FIG. 6A, flange 112 is no longer locked in slot 106 but yet is still sufficiently within slot 106 to provide a guiding function when curtain assembly 27 is being manually extended out of or retracted into header 26. Then, upon release of the button 117 of assemblies 110, curtain assembly 27 will again be held at its intended position by flange 112 being extended by spring 115.

In light of the foregoing, it should thus be evident that a storm protection device constructed as described herein substantially improves the art and otherwise accomplishes the objects of the present invention.

What is claimed is:

1. An apparatus for covering an opening in a building comprising opposed frames each including a slot, a curtain assembly manually movable along said frames, and a device carried by said curtain assembly and having a flange to selectively be receivable by at least one of said slots to guide said curtain assembly along said frames, said device including locking means to hold said curtain assembly at any desired location along said frames by moving said flange further into said slot so that said flange becomes locked in said slot.

2. Apparatus according to claim 1 wherein said curtain assembly includes a fabric sheet having a bar affixed to one end thereof, said bar carrying said locking means.

3. Apparatus according to claim 1 wherein said locking means includes a housing carried by said curtain assembly, a plunger positioned in said housing and carrying said frame, and a spring in said housing biasing said plunger so that said frame is engaged by said slot.

4. Apparatus according to claim 3 wherein said locking means further includes a button operable on said plunger to move said flange out of engagement with said slot.

5. Apparatus according to claim 1 having a periphery defined by said opposed frames, by an upper member and by a lower member; said curtain assembly being adapted to extend between said upper and lower members and between said opposed frames to cover the space therebetween; said upper member, said lower member, and said opposed frames each having a sealing surface such that when said curtain assembly is exposed to a force, the periphery of said curtain assembly can engage each said sealing surface.

6. Apparatus according to claim 1 further comprising a tube, said curtain assembly being adapted to be coiled on said tube when not covering the opening and to be uncoiled from said tube to cover the opening, a spring to bias said curtain assembly toward the coiled position, and a system to adjust the tension on said spring without disassembling the apparatus.

7. Apparatus according to claim 6 having a periphery defined by said opposed frames, by an upper member and by a lower member; said curtain assembly being adapted to extend between said upper and lower members and between said opposed frames to cover the space therebetween; said upper member, said lower member, and said opposed frames each having a sealing surface such that when said curtain assembly is exposed to a force, the periphery of said curtain assembly can engage each said sealing surface.

8. An apparatus for covering an opening in a building comprising a tube, a curtain assembly having one end attached to said tube and adapted to be coiled on said tube when not covering the opening and to be uncoiled from said tube to cover the opening; a spring to bias said curtain assembly toward the coiled position; and a system to adjust the tension on said spring without disassembling the apparatus, said system including a driver, a nut carried by said driver, a gear plate carried by said nut, a pawl assembly; and a housing for said gear plate and said pawl assembly; said spring being attached between said tube and said driver; said gear plate including radially projecting teeth, said pawl assembly selectively engaging a said tooth to hold said gear plate against the force of said spring; and said housing having an opening to expose said nut so that the tension on said spring can be adjusted without disassembly.

9. Apparatus according to claim 8 wherein said pawl assembly includes an arm to engage a said tooth and a spring to urge said arm toward engagement with said tooth.

10. Apparatus according to claim 8 having a periphery defined by an upper member carrying said tube, a lower member, and opposed side members extending between the edges of said upper and lower members; said curtain assembly extending between said upper and lower members and between said side members when uncoiled from said tube to cover the space therebetween; said upper member, said lower member, and said side members each having a sealing surface such that when said curtain assembly is exposed to a force, the periphery of said curtain assembly can engage each said sealing surface.

11. An apparatus for sealing an opening in a building to prevent air and water from passing through the opening comprising a periphery defined by an upper member, a lower member and opposed side members extending between the edges of said upper and lower members; and a curtain assembly adapted to extend between said upper and lower members and between said side members to cover the space therebetween; said upper member, said lower member and said side members each having a sealing surface such that when said curtain assembly is exposed to a force, the periphery of said curtain assembly can engage each said sealing surface.

12. Apparatus according to claim 11 wherein said upper member includes posts extending downwardly therefrom and said opposed side members include a socket to receive said posts to attach said upper member to said side members.

13. Apparatus according to claim 12 wherein said bottom member includes a socket at each end thereof and further comprising corner members each having a first post received in said socket of a said side member and a second post received in said sockets of said bottom member.

14. Apparatus according to claim 11 wherein said upper member includes a housing to carry a coil supply of said curtain assembly, said curtain assembly passing through an opening in said housing.

15. Apparatus according to claim 14 wherein said sealing surface of said upper member is positioned adjacent to said opening.

16. Apparatus according to claim 14 wherein said housing includes a first portion and a second portion, the first portion including the top and one side of said housing, and the second portion including the bottom and other side of said housing, said other side being attached to said top but said one side being spaced from said bottom to define said opening.

17. Apparatus according to claim 16 wherein said sealing surface of said upper member is formed at the edge of said bottom.

18. Apparatus according to claim 14 further comprising a spring to put tension on said coil and an adjusting system in said housing to adjust the tension of said spring.

19. Apparatus according to claim 18, said housing including an end plate to confine said adjusting system in said housing, said end plate having an aperture therein so that access can be gained to said adjusting system without removing said end plate.

20. Apparatus according to claim 19, said housing including a cover plate received over said end plate but removable therefrom to gain access to said end plate.

21. Apparatus according to claim 11 wherein said curtain assembly includes a sheet of fabric, said sheet having a thickened area along each side edge thereof, a said thickened area being received in each said opposed side member.

22. Apparatus according to claim 21 wherein said thickened area is formed by attaching a strip of material to each side edge of said sheet.

23. Apparatus according to claim 21 wherein said thickened area is formed by folding each side edge of each sheet back on itself and attaching the folded edge to said sheet.

24. Apparatus according to claim 11 wherein said lower member includes an upper surface and a lower surface with a step therebetween, said sealing surface of said lower member being formed at the top edge of said upper surface.

25. Apparatus according to claim 24 wherein said curtain assembly includes a fabric sheet and a bar attached to one end of said sheet, said bar being positionable on said step.

26. Apparatus according to claim 25 further comprising at least one guiding and locking device carried by said bar and adapted to engage at least one of said opposed side members to maintain said bar adjacent to said step.

27. Apparatus according to claim 11 wherein each said side member includes a compartment having an opening therein to receive an edge of said curtain assembly therethrough.

28. Apparatus according to claim 27 wherein said curtain assembly includes a sheet of fabric having a thickened area formed along each side edge thereof, said thickened area being totally received in said compartment.

29. Apparatus according to claim 27 wherein said sealing surface of each said side member is formed at said opening in said compartment.

30. An apparatus for sealing an opening in a building to prevent air and water from passing through the opening comprising a periphery defined by an upper member, a lower member, and opposed side frames extending between the edges of said upper and lower members; a tube carried by said upper member; a curtain assembly having one end attached to said tube and adapted to be coiled on said tube when not covering the opening and to be manually uncoiled from said tube and movable along said frames to cover the opening; a spring to bias said curtain assembly toward the coiled position; a system to adjust the tension on said spring without disassembling the apparatus; and a device carried by said curtain assembly to selectively be received by at least one of said frames to guide said curtain assembly along said frames; said upper member, said lower member, and said frames each having a sealing surface such that when said curtain assembly is exposed to a force, the periphery of said curtain assembly can engage each said sealing surface.

* * * * *